US005685080A

United States Patent [19]

Amano et al.

[11] Patent Number: 5,685,080

[45] Date of Patent: Nov. 11, 1997

[54] BATTERY POWERED CHAIN SAW

[75] Inventors: Kunio Amano; Kazuya Nakamura, both of Anjo, Japan

[73] Assignee: Makita Corporation, Anjo, Japan

[21] Appl. No.: 636,871

[22] Filed: Apr. 22, 1996

[51] Int. Cl.[6] ..... B27B 17/02

[52] U.S. Cl. ..... 30/383; 30/DIG. 1

[58] Field of Search ..... 30/381–387, 500, 30/DIG. 1, 216, 210; 318/134; 320/2

[56] References Cited

U.S. PATENT DOCUMENTS

| | | | |
|---|---|---|---|
| 3,212,188 | 10/1965 | Riley et al. | 30/216 |
| 4,335,514 | 6/1982 | Overy et al. | 30/382 |
| 4,389,779 | 6/1983 | Overbury et al. | 30/382 |
| 5,213,913 | 5/1993 | Anthony et al. | 30/500 X |

*Primary Examiner*—Douglas D. Watts
*Attorney, Agent, or Firm*—Cushman Darby & Cushman IP Group of Pillsbury Madison & Sutro, LLP

[57] ABSTRACT

A gear housing is arranged at or by the center of a main body housing of a chain saw and a handle housing extends backward therefrom. A motor housing is formed on the left side of the gear housing perpendicularly. A support member and a cover are attached on the right side of the gear housing. A guide bar extends forward from the main body housing and the guide bar retrains an endless saw chain therearound. The handle housing includes a trigger beside a connecting portion between the handle housing and the gear housing. A battery is disposed in a detachable manner at a rear end of the handle housing.

The center of gravity of the chain saw is located at or by the trigger of the handle housing.

3 Claims, 3 Drawing Sheets

BATTERY POWERED CHAIN SAW

BACKGROUND OF THE INVENTION

The present invention relates to a chain saw of electrically driven type for cutting a log or the like with a saw chain driven by a motor.

A conventional chain saw comprises a main body in which a motor is housed. A guide bar on which a saw chain is retained extends forward from the main body. A handle with a trigger of a switch extends backward from the main body. The saw chain is engaged with a sprocket rotated by the motor in the main body so that the saw chain travels around the guide bar. An electric code extends from the rear end of the handle. Electric power is provided from an external power source through a plug connected with an end of the cord. A grip and a protector are formed on the top side of the main body, respectively (See USPs. 4,389,779 and 4,335,514).

In the conventional chain saw, the electric power is provided from the external source through the cord that is inconvenient for an operator in handling. An additional cord may be required when the power source is far from the chain saw. Therefore, operation for the chain saw and cutting operation by the chain saw may be restricted or deteriorated due to the inconvenient cord.

SUMMARY OF THE INVENTION

It is an object of the present invention to solve the problem of the operation for the chain saw and the cutting operation by the chain saw.

It is another object of the present invention to provide a novel chain saw of aiming to improve the operations due to arrangement of parts of the chain saw. At least one of the objects is achieved by mounting a battery on the chain saw to provide electric power with the motor.

It is desirable in the chain saw of the present invention to dispose the motor at the substantial center of a main body and to dispose a guide bar with a saw chain on the front side of the main body, and furthermore, to dispose the battery in a detachable manner at the rear end of a handle extending backward from the main body.

A housing of the motor may be designed as a grip.

The power for the motor is delivered from the battery mounted so that prefer operation for the chain saw and prefer cuttng operation by the chain saw are obtained in spite of the inconvenient cord.

When arranging the guide bar in a forward direction from the motor mounted in the substantial center of the main body and arranging the handle and battery in a backward direction from the motor, the center of gravity of the chain saw shifts backward as the battery is arranged backward. The weight balance of the chain saw is so improved that the chain saw becomes good in handling.

Configuration of housing is simplified in the case where the housing of motor is designed as the grip.

BRIEF DESCRIPTION OF THE DRAWINGS

The present invention is illustrated in the accompanying drawings, in which.

DESCRIPTION OF THE PREFERRED EMBODIMENT

An embodiment of the present invention is described hereinbelow with regard to the attached drawings hereinbelow.

Figure 1:
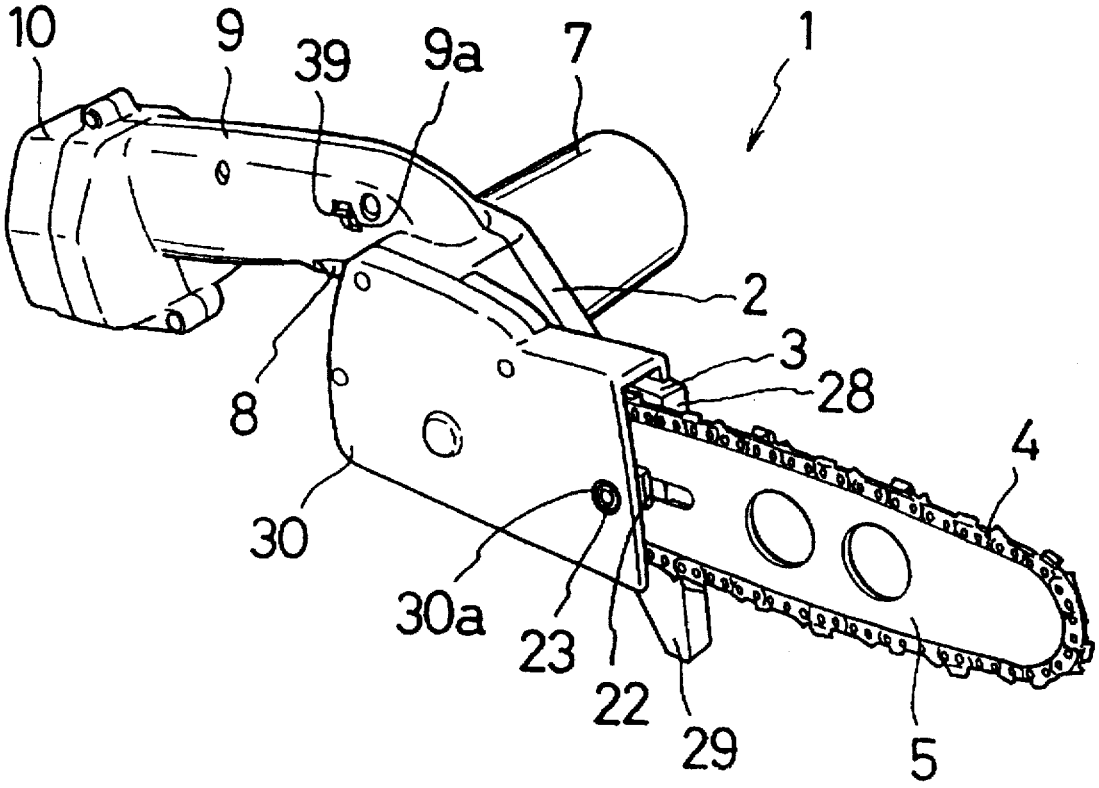
FIG. 1 is a perspective view of a chain saw of an embodiment of the present invention.

FIG. 1 is a perspective view of a chain saw 1. The chain saw 1 comprises a main body housing that had been divided into two pieces in the longitudinal direction beforehand. The main body housing comprises a gear housing 2 at or near the center thereof and a handle housing 9 extending backward therefrom, respectively (i.e., in the left direction in FIG. 1, description will be made hereinbelow as that the direction to which handle housing 9 extends is the backward direction).

A motor housing 7 of a motor is formed on the left side of the gear housing 2 perpendicularly. A support member 3 and a cover 30 are attached on the right side of the gear housing 2. A guide bar 5 extends forward therefrom and the guide bar retrains an endless saw chain 4 therearound. The handle housing 9 comprises a trigger 8 beside a connecting portion between the handle housing 9 and the gear housing 2. A battery 10 is disposed in a detachable manner at a rear end of the handle housing 9. The center of gravity of the chain saw is located at or by the trigger 8 of the handle housing 9.

Figure 2:
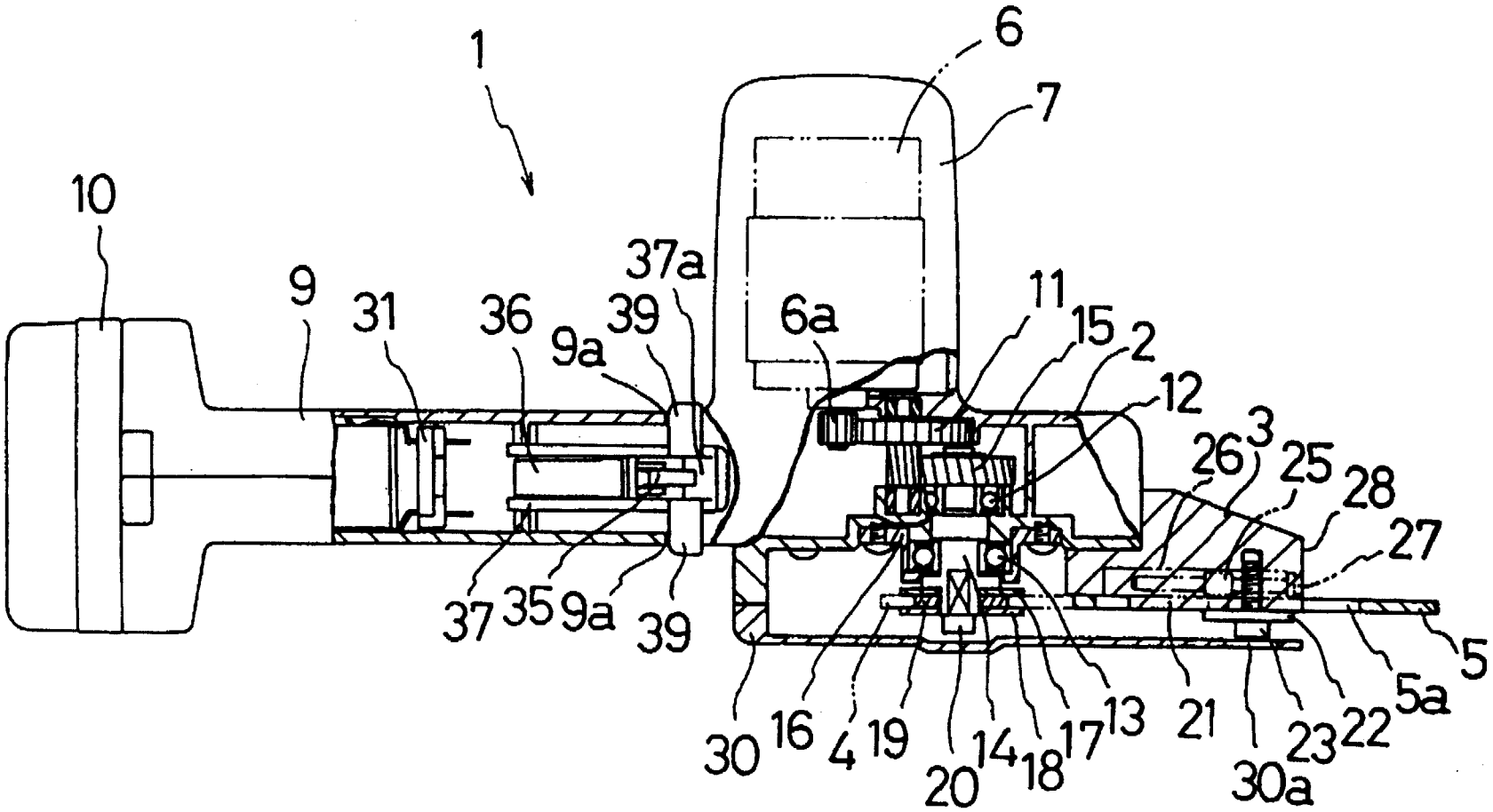
FIG. 2 is a plane view, partially in section, of the chain saw.
Figure 3:
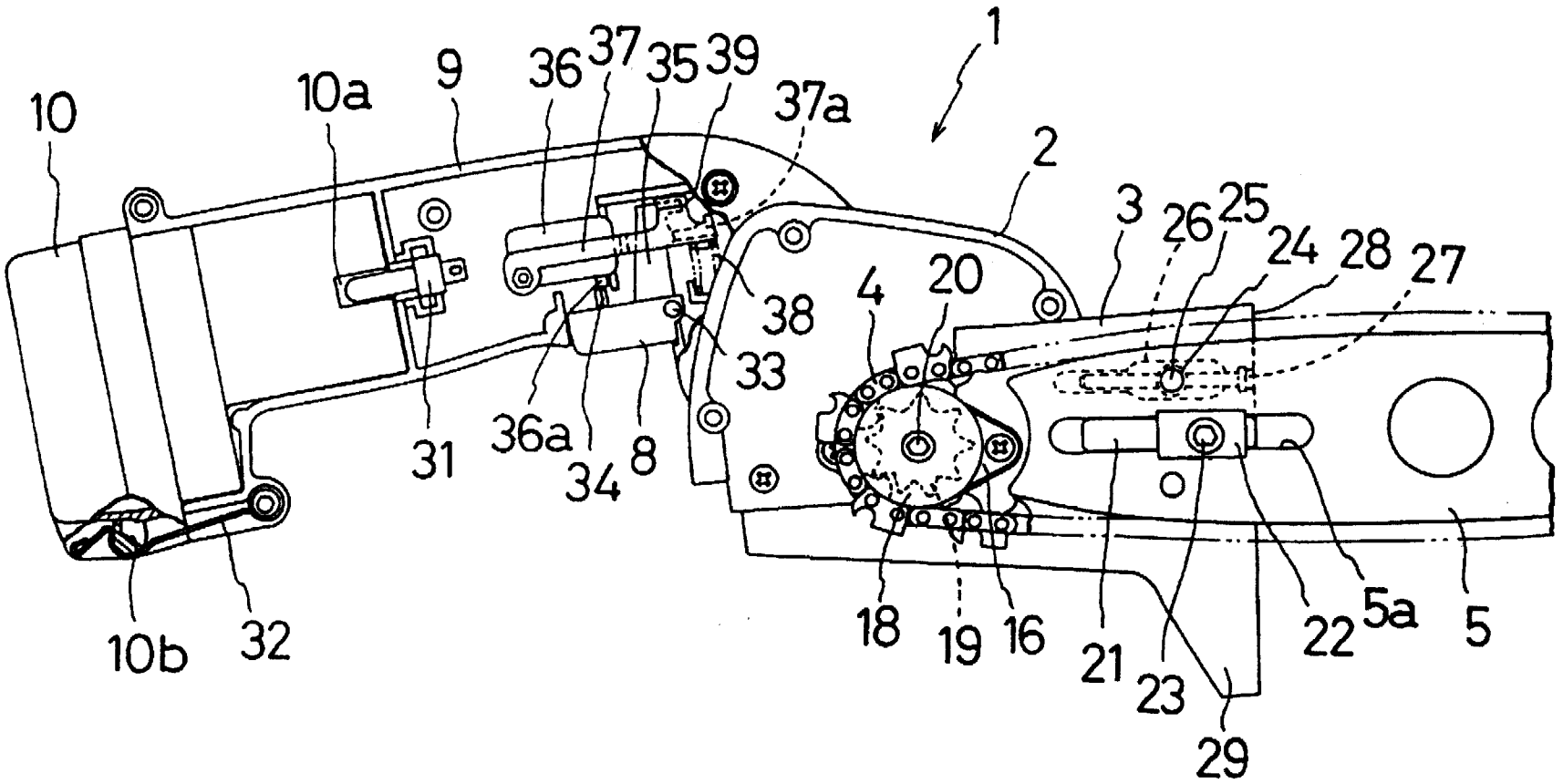
FIG. 3 is an elevational view, partially in section, of the chain saw.

FIGS. 2 and 3 are views of explaining an internal mechanism of the chain saw 1 (electric lines are omitted). A motor shaft 6*a* of a motor 6 housed in the motor housing 7 engages with a first gear 11 being pivotally carried in the gear housing 2. The first gear 11 engages with a second gear 15 that is secured to a spindle 14 being carried in ball bearings 12 and 13. Rotation of the motor 6 is thus transferred to the spindle 14. Furthermore, a free end of the spindle 14 is out of a bearing box 16 that is screwed into the gear housing 9. The free end of the spindle 14 is chamfered into two surfaces to which a sprocket 19 is fitted by a bolt 20. The sprocket 19 is supported by washers 17 and 18.

A ridge 21 projects in a forward-backward direction on the support member 3 that is secured on the gear housing 2. The ridge 21 fits into a long opening 5*a* formed in a longitudinal direction of the guide bar 5.

A lock plate 22 is screwed into the ridge 21 by a bolt 23. The lock plate 22 can fix the guide bar 5 by tightening the bolt 23. The saw chain 4 to be attached to the guide bar 5 is wound around a groove, not shown in FIGS., formed around the sprocket 19 through the guide bar 5. The saw chain 4 thereby travels around the guide bar due to the rotation of the sprocket 19. A through hole 24 is formed in the guide bar 5. A slide hole 26, in which a control pin 25 is installed, is formed in the forward-backward direction in the support member 3. The free end of the control pin 25 is fitted into the through hole 24. A control screw 27, which is parallel with the guide bar 5 and is allowed only to turn, is inserted into the support member 3. The control screw 27 is screwed with the control pin 25. When the control screw 27 is turned while slightly loosening the bolt 23 to release the guide bar 5 fixed by the lock plate 22, the control pin 25 moves within the slide hole 26 in the forward-backward direction as the turn of the control screw 27. The guide bar 5 also slides in the forward-backward direction as the movement of the control pin 25. It is therefore allowed to make detailed control of tensional condition of the saw chain 4.

The support member 3 has at its front end a plane guide surface 28 that is perpendicular to the guide bar 5. The support member also has a projection portion 29 projecting downward from the guide bar 5 as shown in FIGS. 1 and 3.

The cover 30 covers the gear housing 2 and the support member 3 and the cover 30 is screwed into the gear housing 2. The sprocket 19 and the rear end of the guide bar 5 are covered by the cover 30 whereas the bolt 23 is exposed across the through hole 30*a* when the covet 30 is assembled.

The battery 10 to be mounted into the handle housing 9 includes plural cells and is a charged type (9.6 V). Plus and minus terminals 10*a* at the front end of the battery 10 are grasped by the battery holder 31 of the handle housing 9 to make an electrical connection therebetween when a small diameter portion in the front half of the battery is inserted into an opening formed at the rear end of the handle housing 9. The battery 10 is fastened to the handle housing 9 by hooking a set plate 32, which is carried on the handle housing 9, on a portion 10*b* to be hooked formed in the rear half of the battery 10. A trigger 8 appeared in the front and under side of the handle housing 9 is pivotally carried on the handle housing 9 by pins 33 projected from each side of the trigger. The trigger 8 is so constructed that a pushing portion 4 thereof pushes a pin plunger 36*a* of a switch 36, which is continually biased in its projection direction, to turn on the switch 36. a lock-off lever 37 is pivotally carried on the handle housing 9 at its rear end behind the switch 36 while being biased upward at the front end by a compression spring 38. Operational pieces 39 and 39 formed on each side of the front end of the lever penetrate through the openings 9*a* and 9*a* formed on each side of the handle housing 9 to prevent upward rotation of the lever. Therefore, in an usually mode, it is prevented to pull the trigger 8 because a contact piece 35 projected upward from the trigger 8 is in contact with a lock plate 37*a* located in front of the lock-off lever 37 of being in the uppermost position. The contact between the contact piece 35 and the lock plate 37*a* is released to allow the trigger 8 to be pulled as pushing the operational pieces 39 and 39 down to rotate downward the front end of the lock-off lever 37.

The chain saw 1 configured as mentioned above is driven as follows. The charged battery 10 is mounted at first. The switch 36 turns on to drive the motor 6 when the trigger 8 is pulled as releasing the lock of the trigger 8 by pushing the operational pieces 39 and 39 down in the manner as mentioned above. The rotation of the motor shaft causes the rotation of the spindle 14 through the first gear 11 and the second gear 15. The sprocket 19 at the end of the spindl 14 is rotated, accordingly. The saw chain 4 engaged with the sprocket 19 thus travels around the guide bar 5 to perform cutting operation for a log or the like. In the cahin saw of the present embodiment, a longitudinal axis of the handle housing 9 inclines downward in the backward direction with respect to a longitudinal axis of guide bar 5.

According to this arrangement, it is easy for an operator to apply a lord for cutting against a material to be cut. It is apparent that an effect of improving efficiency of cutting operation is achieved.

After releasing the trigger 8, the trigger 8 returns to the former position by the pin plunger 36 continually biased and the switch 6 turns off. The switch 6 comprises an electric brake that switches the motor 6 between a battery circuit side and a short—circuit side for short-circuiting terminals of the motor 6. The switch 36 is at the position of the battery circuit side to provide electric power with the motor 6 when the trigger 8 is in pulled state (ON state). The switch 36 switchs to the short—circuit side when the trigger 8 is in released state (OFF state). A reverse electromotive force is then generated to apply a reverse force to the motor 6 so as to stop rotation of the motor 6 immediately. It is thereby free from a drawback of interrupting the cutting operation during the inertial rotation of the motor 6 after releasing the trigger 8 and therefore impairment of the cutting operation does not occur.

The electric power is provided from the battery 10 mounted in the chain saw 1 in the embodiment, without using an electric cord and an additional cord. The operator thereby can handle the chain saw with preferable operation therefor. The guide bar 5 entraining the saw chain 4, the gear housing 2, the motor housing 7, the handle housing 9 and the battery 10 are arranged as mentioned above, in particular as shown in FIG. 1, the center of gravity of the chain saw 1 is located at or by the trigger 8, that is at or by the center of the chain saw 1. The operator handles the chain saw by his both hands in good balance when gripping the handle housing 9 by his right hand and gripping the motor housing 7 as a grip by his left hand. Therefore, prefer operation for the chain saw is obtained. Configuration of housing is simplified by having, in particular, the motor housing 7 be used as the grip. This configuration results in decreasing cost of the chain saw. Furthermore, a guide surface 28 and a projection portion 29 are formed on the support member 3 of the guide bar 5. When cutting operation or another operation is performed as having the chain saw 1 be perpendicular and directing the saw chain 4 downward, the guide surface 28 is used as a guide for cutting by contacting guide surface 28 to a material to be cut so that operation for the chain saw 1 is improved.

When operation for cutting branches is performed, the chain saw 1 can be correctly positioned with respect to the branch to be cut by using a corner formed between the projection portion 29 and the guide bar 5 so that the chain saw 1 is more convenient to use.

It is allowed to modify the shape of the motor housing 7 such as forming a finger contacting portion or the like to improve gripping condition for the operator because the motor housing 7 in the embodiment is used also as the grip. It is, of course, allowed to form another grip, which is not used as the motor housing, on the motor housing or gear housing. Capacity and configuration of the battery are not lmited by the shown embodiment. It is also allowed to modify the configuration of the handle according to the battery to be mounted.

According to the present invention, a battery type chain saw of cordless is provided. Good operation for the chain saw and good cutting operation by the cahin saw are obtained regardless of handling of the cord. It is expected to obtain further improvement in the operation for the chain saw and the cutting operation by the chain saw when the balance of the chain saw is better in total by arranging, in particular, the motor at the center, the guide bar in front of the motor and the battery behind the motor.

Configuration of housing is simplified by designing the motor housing as the grip and it results in decreasing manufacturing cost of the chain saw.

Although the invention has been disclosed in the context of a certain preferred embodiment, it will be understood that the present invention extends beyond the specifically disclosed embodiment to other alternative embodiments of the invention. Thus it is intended that the scope of the invention should not be limited by the disclosed embodiment, but should be determined by reference to the claims that follow.

We claim:

1. A chain saw comprising:

a main body having a front portion, a rear portion and a central portion between said front and rear portions, said main body including a handle extending from said rear portion;

a guide bar extending from said front portion of said main body;

a cutting chain disposed around said guide bar;

a motor for driving said cutting chain, said motor having a trigger for actuating the chain saw, said motor and said trigger being disposed generally at said central portion of said main body; and a battery providing electric power to said motor, said battery being detachably connected to a rear portion of said handle, wherein a center of gravity of said chain saw is located generally at said trigger of said motor when said battery is attached to said handle.

2. A chain saw according to claim 1, wherein said handle is constructed and arranged to permit gripping thereof.

3. A chain saw according to claim 1, wherein said handle inclines downwardly and in a rearward direction with respect to a longitudinal axis of said guide bar.

* * * * *